US006431933B1

(12) United States Patent
Saghri

(10) Patent No.: US 6,431,933 B1
(45) Date of Patent: Aug. 13, 2002

(54) BODY BOARD HAVING FLEXIBLE PROPULSION EXTENSIONS

(76) Inventor: Abdolhamid Saghri, 7301 Sweetwater Blvd., Murrells Inlet, SC (US) 29576

( * ) Notice: Subject to any disclaimer, the term of this patent is extended or adjusted under 35 U.S.C. 154(b) by 0 days.

(21) Appl. No.: 09/849,370

(22) Filed: May 7, 2001

(51) Int. Cl.[7] ..... B63B 1/00
(52) U.S. Cl. ..... 441/65; 440/9
(58) Field of Search ..... 441/65, 66, 67, 441/69, 74, 75, 79; 440/9, 22

(56) References Cited

U.S. PATENT DOCUMENTS 4,929,207 A * 5/1990 Piatt ..... 441/65
5,385,495 A * 1/1995 Henns ..... 441/79
5,498,184 A 3/1996 Saghri
5,591,060 A * 1/1997 Forsyth ..... 441/75
5,738,555 A 4/1998 Saghri
5,810,630 A 9/1998 Saghri

* cited by examiner

*Primary Examiner*—Stephen Avila
(74) *Attorney, Agent, or Firm*—Nixon & Vanderhye

(57) ABSTRACT

A body board includes a pair of extensions along opposite sides adjacent the stern of the board. The extensions have a rearwardly-facing surface defining a volume for receiving water by which the body board may be propelled. The extensions are formed of a flexible material enabling folding of the extensions onto the surface of the body board to reduce the lateral and height dimensions of the body board for handling, shipping, transportation and storage purposes. To maintain the extensions in operable configuration, an insert is provided for reception within the extensions and is formed of a material more rigid than the flexible material of the extensions.

22 Claims, 10 Drawing Sheets

BODY BOARD HAVING FLEXIBLE PROPULSION EXTENSIONS

BACKGROUND AND SUMMARY OF THE INVENTION

The present invention relates to a body board having a pair of extensions forming hydrodynamic propulsion surfaces adjacent the stern of the body board and particularly relates to a body board having flexible and removable extensions to facilitate storage, handling, transportation and packaging of the body board and extensions.

Body or boogie boards as commonly known generally comprise a board on which an individual may ride an incoming wave. Extensions for body boards to provide a propulsion assist to the body board are also well known. See, for example, my prior U.S. Pat. Nos. 5,810,630; 5,498,184 and 5,738,555, the subject matters of which are incorporated herein by reference. In those patents, there are provided rigid extensions adjacent opposite side edges of the body board and near the stern of the body board which provide a generally stern-facing recessed surface. Water delivered in a direction generally from behind the body board toward its stern exerts a force against the surface to propel the body board forwardly. These body boards with extensions provide a propulsive effect which is a significant improvement over body boards without such extensions. However, the extensions are somewhat bulky and substantially increase the lateral and height dimensions of the body board. From a review of the body board with extensions in the above-identified patents, it will be appreciated that this increased size or bulk significantly impacts the ability of a manufacturer, as well as a retailer, to handle, store, transport and/or package the body board with extensions. For example, in shipping body boards with rigid extensions secured adjacent opposite side edges thereof, the bulk of the extensions on the body board necessarily reduces the quantity of body boards which may be shipped and/or stored in a given volume, even when the body boards are arranged or stacked bow-to-stern and alternately inverted relative to one another to reduce their aggregate volume. Accordingly, there is a need for a body board with extensions wherein the bulk or volume of the body board, including the extensions, can be substantially reduced to facilitate the handling, storage, transportation and packaging of the body boards with extensions.

In accordance with a preferred embodiment of the present invention, there is provided a body board member having a bow and stern and generally in a conventional configuration of a body board. Along opposite side edges and adjacent the stern of the body board, there is provided a pair of extensions formed of a flexible material, such as a foam plastic material. Each extension provides a recessed surface generally facing aft from the stern of the body member such that water delivered in a direction generally toward the stern exerts a force against the generally rearward-facing recessed surface to propel the body board in a forward direction. Each extension is shaped such that an area defined by the rearward-facing recessed surface is substantially equivalent to a maximum cross-sectional area of that extension taken along a plane perpendicular to a longitudinal axis of the body board member and such that the maximum cross-sectional area of the extension facing aft is located proximate the stern of the body member.

In a preferred embodiment, the extensions are formed of a flexible material and in the general shape of a cone with the base of the cone opening in a stern direction and corresponding substantially to the maximum cross-sectional area against which water impacts to propel the body board. With the extensions secured along opposite side edges of the body board, the flexible extensions may be folded over a surface of the body board, preferably the upper surface, to decrease the bulk of the body board with extensions. Particularly, the lateral and height dimensions of the body board with extensions are significantly reduced by folding the extensions over a surface of the body board. Thus, when the extensions are folded from a first shape, i.e., an operable configuration, to a second shape, i.e., an inoperable configuration designed to facilitate handling, storage, transportation and packaging of the body board with extensions, the product is significantly reduced in bulk, i.e., volume. For example, when the extensions are folded into and secured in their second positions, about twice as many body boards may be provided in a given volume, e.g., for storage or transport, than with the extensions in a fully operable condition.

While the extensions formed of flexible material may be folded to reduce the bulk of the product with the extensions retained in their folded configurations, e.g., by strapping, it has also been found that the extensions will tend to expand toward their original shape, i.e., their operable shape, but have insufficient memory once unfolded to return fully to their operable shape. To accommodate this phenomena, inserts are provided for use with the body board. The inserts are formed of a material having greater rigidity than the flexible material of the extensions. The inserts may thus be inserted through the open stern ends of the extensions such that the extensions assume their original operable, generally conical configuration and volume and are maintained in that configuration by the inserts. In a preferred embodiment, the inserts may be formed in a frustoconical shape having the same general shape as the first or operational shape of the extensions but shortened at opposite ends. The inserts are retained within the extensions by any number of various methods. For example, one or more stops may be formed on the inside surface of each extension. The stops are compressible to enable insertion of the insert into the extension through its large open end and are depressible to release the insert when desired. Alternatively, protrusions may be formed on the outside surface of the insert to engage the interior surface of the extensions to retain the inserts within the extensions. A further alternative provides hook-and-loop fasteners cooperable between the insert and inside surface of the extensions to retain the inserts within the extensions. As a further alternative, the insert may have a plurality of holes which, upon insertion and full seating of the insert in the extension, receive portions of the flexible material whereby the flexible material portions form stops preventing removal of the insert from the extension.

In another preferred embodiment of the present invention, the extensions are removable from the body board. To accomplish this, female receptacles are formed along the side edges of body board, preferably two receptacles per side. Preferably, those female receptacles have screw threads and in one form may comprise opposite ends of a rod passed laterally through the body board. Male parts, preferably having screw threads, are provided through the extensions for threaded engagement with the female parts, the male parts having enlarged heads to facilitate retention of the extensions along opposite sides of the board member.

It will therefore be appreciated that the flexibility of the extensions permits significant reductions in the bulk of the board product when shipped, transported or stored with the extensions secured to the board. A user of the board with extensions may also flatten the extensions, e.g., when transporting the board with extensions in the trunk of an automobile. The inserts may be provided separately in a nested, i.e., stacked, configuration, resulting in a significant reduction in the overall volume required to ship, store or transport the body board. Releasable securement of the extensions to the body board also results in a significant reduction in bulk, since the extensions can be nested and provided separately. This latter configuration is also significant in that the body boards can be manufactured and sold with the female parts, e.g., rods, extending through the boards for subsequent securement of extensions to the boards on an as-needed or desired basis. Thus, the boards can be used with or without the extensions as desirable.

In a preferred embodiment according to the present invention, there is provided a body board comprising an elongated body board member having a bow and a stern and substantially flat surfaces on opposite sides, the body member being capable of supporting an individual lying on a first flat surface thereof, a pair of extensions coupled to the body member adjacent opposite sides of the body member, each extension of the pair of extensions and in a first configuration thereof having a first height dimension, each extension providing an aft facing surface so that water delivered in a direction generally toward the body member and the stern thereof exerts a force against the aft-facing surface to propel the body board and the aft-facing surface of each extension in the first configuration thereof defining a volume of decreasing cross-sectional area in a direction toward the bow, each extension being formed of a flexible material enabling the extension to be folded into a second configuration at least in part overlying one of the flat surfaces of the board to provide a second height dimension thereof less than the first height dimension.

In a further preferred embodiment according to the present invention, there is provided a body board comprising an elongated body board member having a bow and a stern and substantially flat surfaces on opposite sides, the body member being capable of supporting an individual lying on a first flat surface thereof, a pair of extensions releasably coupled to the body member adjacent opposite sides of the body member, each extension of the pair of extensions and in a first configuration thereof having portions extending beyond the height and lateral confines of the board to define a first envelope, each extension providing an aft facing surface so that water delivered in a direction generally toward the body member and the stern thereof exerts a force against the aft-facing surface to propel the body board and the aft-facing surface of each extension in the first configuration thereof defining a volume of decreasing cross-sectional area in a direction toward the bow, each extension being formed of a flexible material enabling the extension to be folded into a second configuration at least in part overlying one of the flat surfaces of the board to provide a second envelope within the confines of the first envelope.

DETAILED DESCRIPTION OF THE DRAWINGS

Figure 1:
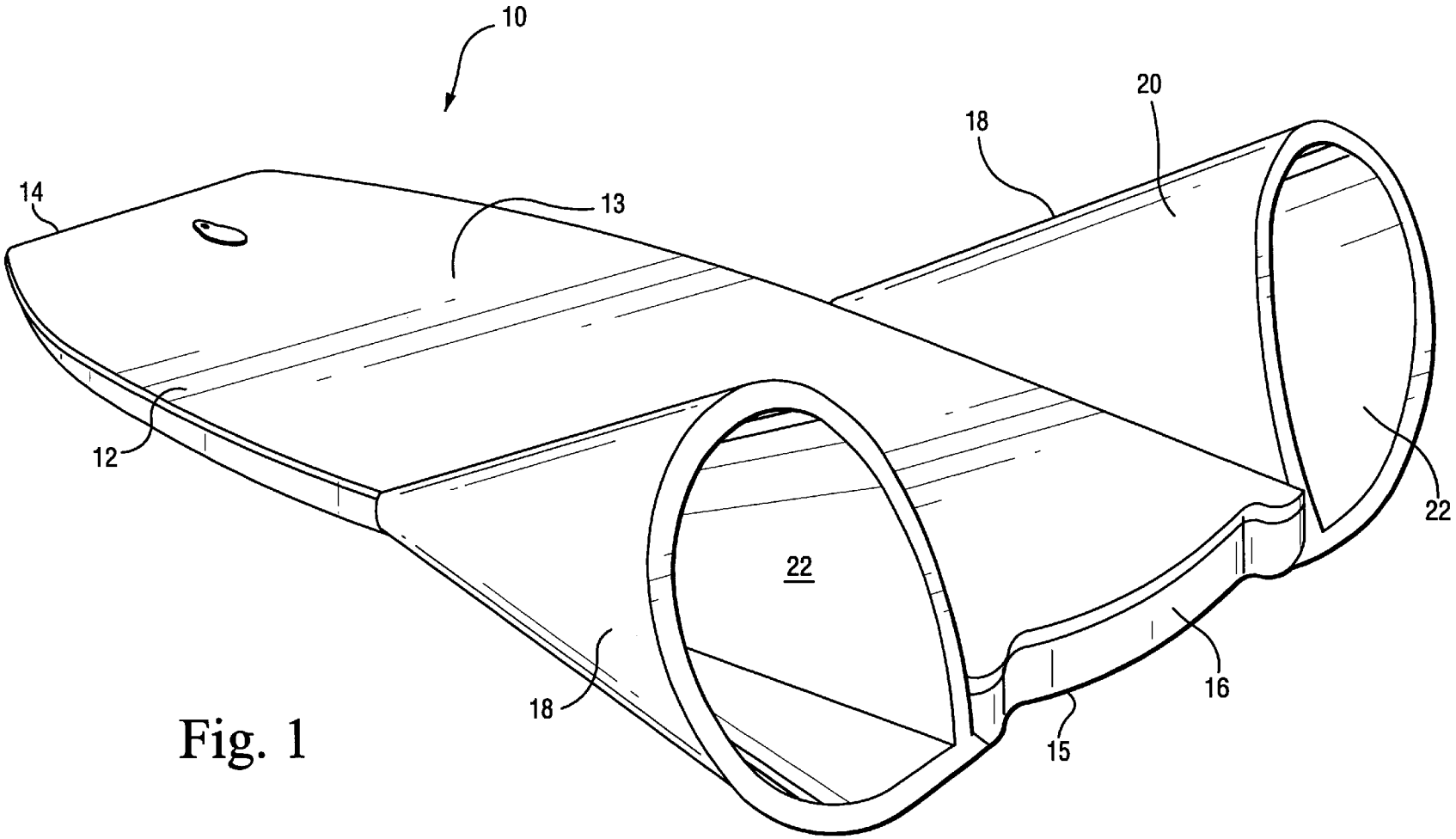
FIG. 1 is a top, port side and stern perspective view of a body board with extensions according to the present invention.

Referring now to the drawing figures, particularly to FIG. 1, there is illustrated a body board, generally indicated 10, including a body board member 12 having a bow 14 and a stern 16. Opposite surfaces 13 and 15 of the body member 12 are substantially flat, although the underside of a portion of the bow 14 is curved upwardly. In normal use, an individual lies on the upper surface 13 of the body member 12 with their legs hanging over the stern 16. The body member 12 is formed of conventional, substantially rigid plastic material.

Figure 2:
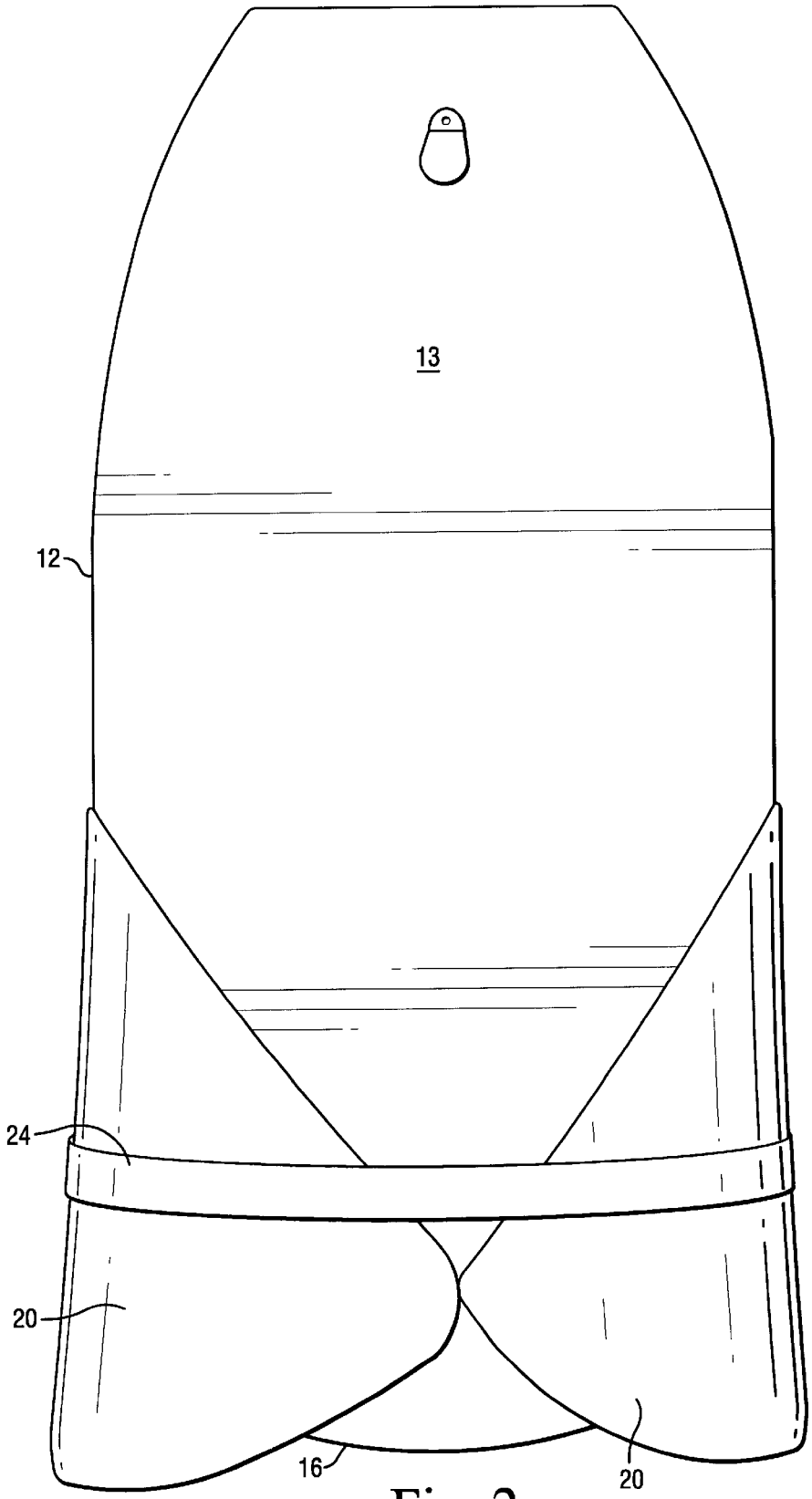
FIG. 2 is a top plan view thereof illustrating the flexible extensions folded in a transport or packaged configuration.
Figure 3:
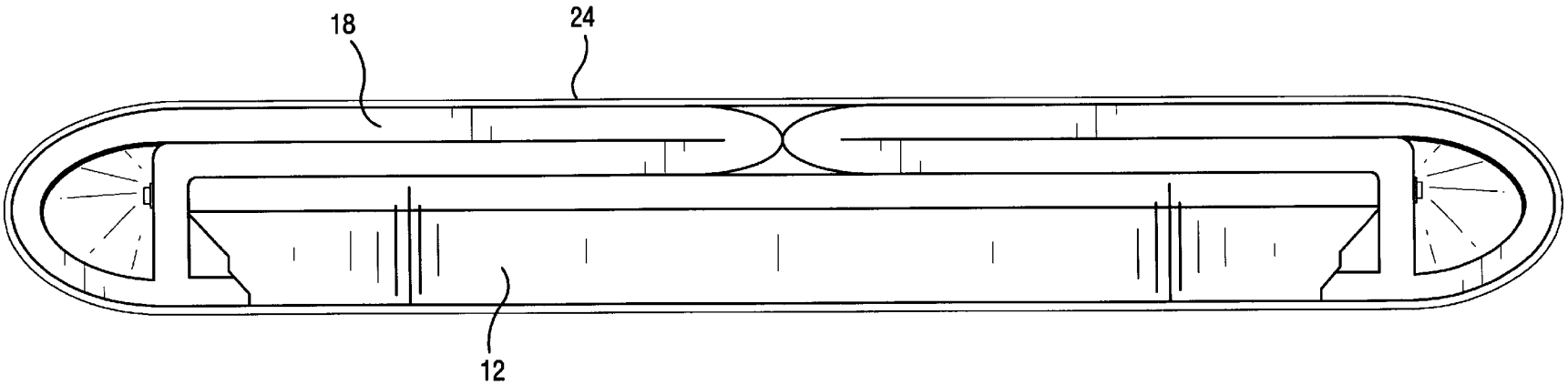
FIG. 3 is a stern end elevational view of the body board with the extensions folded and secured in a non-operable configuration.
Figure 14:
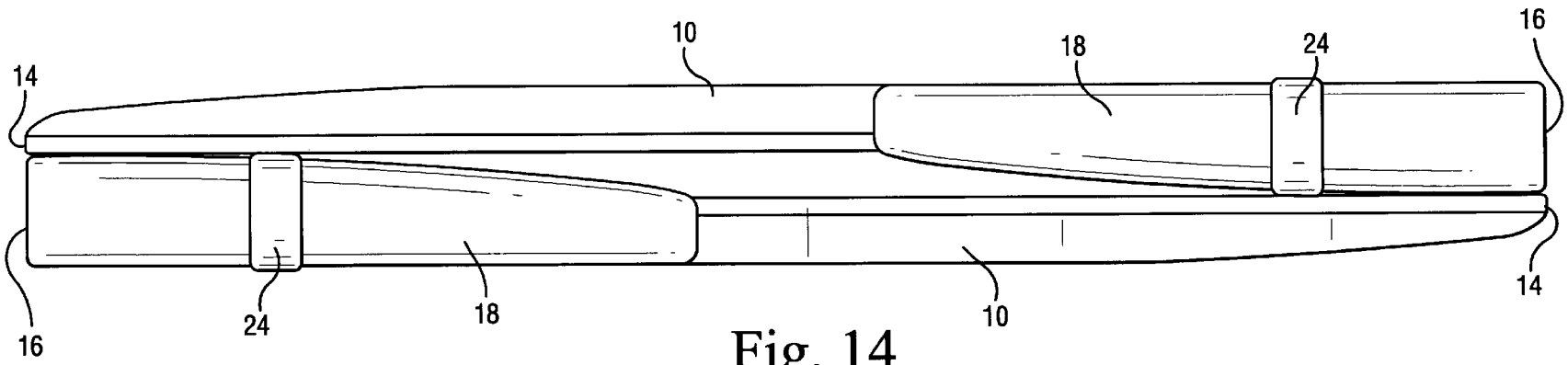
FIG. 14 is a side elevational view illustrating body boards with extensions in a folded transport or storage configuration.

As also illustrated in FIG. 1, a pair of extensions 18 are provided along opposite sides of the body board member 12 and are positioned toward the stern half of the body member 12. These extensions 18 form a propulsion system for the body board 10. Extensions 18 in the first operable configuration illustrated in FIGS. 1 and 3 are generally conical in shape. The walls 20 of extensions 18 thus define volumes 22 within extensions 18 with the large ends of the generally cone-shaped opening in an aft direction. It will be appreciated that the rearwardly facing surface defining the volumes 22 within the extensions extend to a maximum cross-sectional area adjacent the aft end of the extensions 18. In a preferred embodiment, the extensions 18 are formed of a flexible closed-cell plastic material. Not only can the extensions therefore be fabricated from flat plastic material and folded over into conically-shaped sections to form the extensions 18 as illustrated and encompassing the volume 22, but the extensions 18 can be flexed and hence folded over relative to either surface 13 and 15 of the body member 12 into a second or inoperable configuration to reduce the bulk of the product. For example, as illustrated in FIGS. 2 and 3, the flexible extensions 18 are illustrated as folded over the upper surface 13 of the board member 12 and held in that position by a wide strap 24. While a strap 24 is illustrated, it will be appreciated that other means may be provided to retain the flexible extensions 18 in the folded and illustrated position, such as plastic wrap. Upon comparison with FIGS. 1 and 2, the folded inoperable configuration of the product substantially reduces the bulk of the product in both lateral and height dimensions, facilitating the handling, storage, transportation and packaging of the product. For example, as illustrated in FIG. 14, a pair of body boards 10 are disclosed in a stacked or nested relation one to the other. The body boards are disposed such that the folded extensions 18 of a first body board lie opposite the bow of a second body board, while the folded extensions of the second body board lie opposite the bow of the first body board. In this manner, a nested storage, handling and transportation packaging configuration of substantially reduced bulk is provided.

Figures 4, 5:
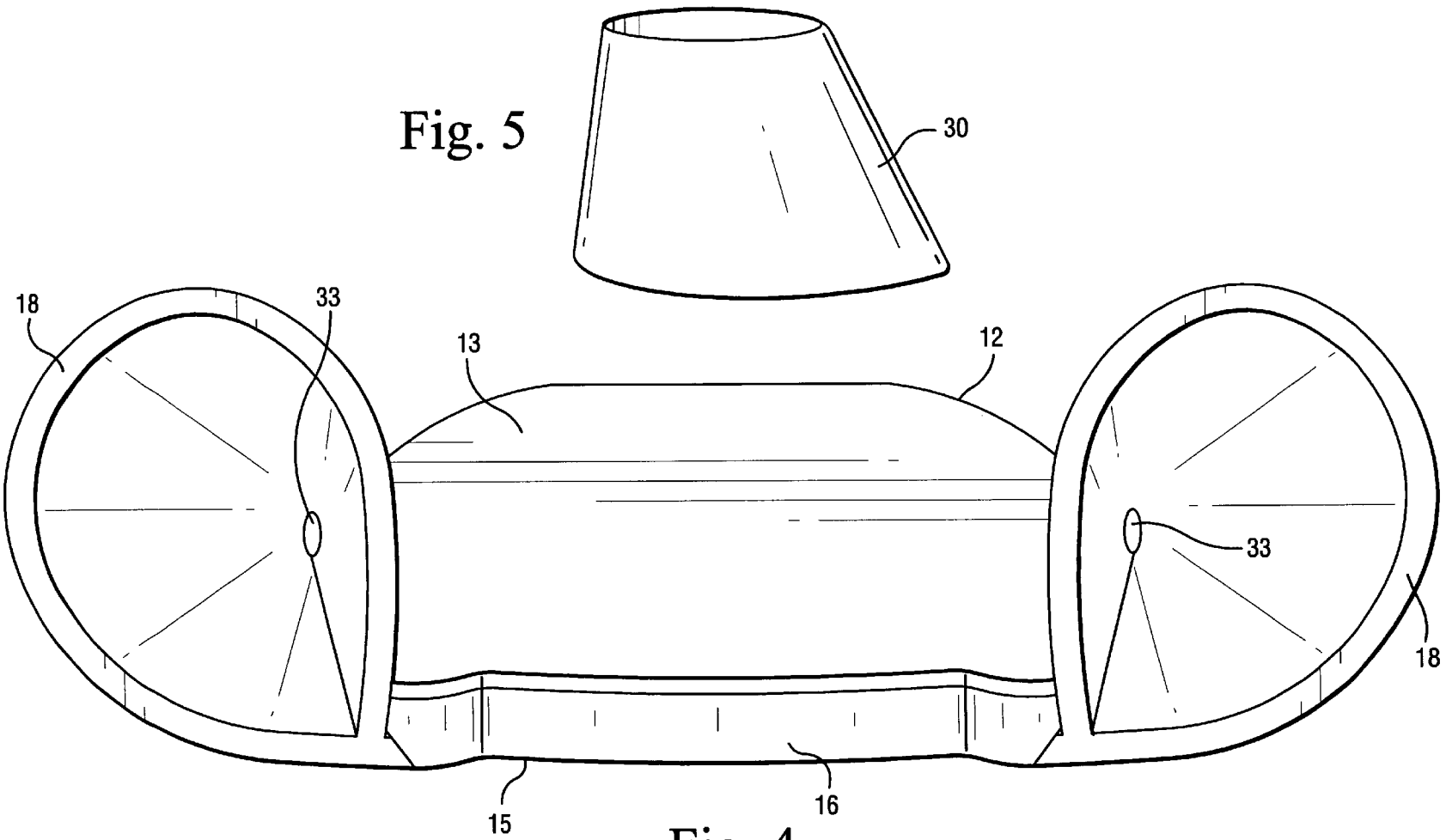
FIG. 4 is a perspective view of the body board product as viewed from the stern and in an operable configuration.
FIG. 5 is an elevational view of an insert.
Figure 6:
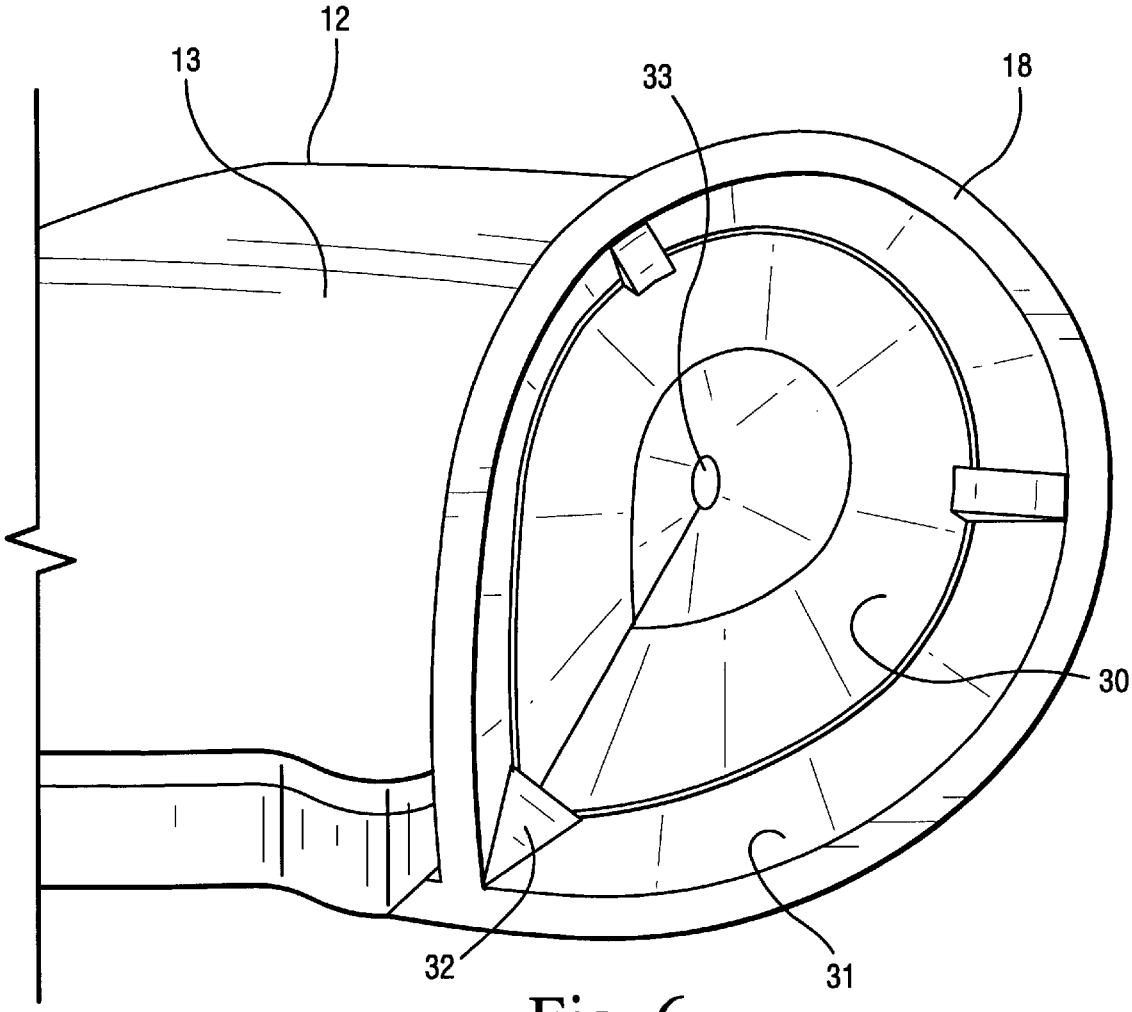
FIG. 6 is an enlarged perspective view of one side of the product as viewed from the stern and illustrating an insert in the starboard extension.

The flexible extensions 18 are also provided when folded into the operable position with openings 33 at their forward ends (FIGS. 4 and 6). Each opening 33 not only serves as a drainage opening after use, for example, when rinsing the board to remove sand, but also facilitates folding the extensions 18 into the configurations shown in FIGS. 4 and 6. By forming the opening 33 adjacent the apex of the generally conically-shaped extension 18, the extension 18 is more readily foldable into its operable configuration. It also reduces the stress on the extension in general and particularly on the joint with the body board member 12. It will also be appreciated that the flexible material of each extension need not have a uniform thickness. That is, the flexible foam material of each extension may be thinner adjacent its forward end, e.g., the foam material may be progressively reduced in thickness from the aft end of the conical extension toward its forward end.

It has been found, however, that after storage and/or transportation in the folded inoperable configuration of the extensions 18, the extensions 18 only partially return to their first operational state or configuration, as illustrated in FIG. 1 upon release of the strap 24. That is, the extensions have insufficient memory to return fully to their first shape from their folded-over second shape to enable the extensions to be useful in propelling the board member. To overcome that problem, an insert 30 is provided for each of the extensions. The insert is illustrated in FIG. 5 and includes a generally frustoconical section 30 for reception within the extensions 18, the insert having the same general configuration as the inside surface of the extensions. The material forming the insert 30 is more rigid than the flexible material forming the extensions 18. Upon insertion of the insert 30 through the open end of and into the volume of the extensions into engagement with the outer surface of the insert against the rearward-facing surface defining the volume of the extensions 18, the extensions may be returned to their first operational shape as illustrated in FIGS. 1 and 6. The insert 30 preferably has a length short of the length of the interior volume of the extensions and may have a length just sufficient to maintain the extensions in their first shape.

To facilitate retention of the inserts in the volume, one or more stops may be provided along the rearward-facing surface 31 of each extension 18. Referring to FIG. 6, the one or more stops may comprise inwardly directed projections 32 formed of the same flexible material from which the extensions are formed. By directing these projections radially inwardly into the volume 22 of the extension and in a plane adjacent the rear open end of the extensions, the insert 30 can be inserted through that open end. As the insert passes the projections or stops 32, the stops 32 are deformed outwardly to permit the insert to pass the stops. The stops then reform into positions bearing against the outer edges of the inserts, preventing removal or at least inhibiting removal of the inserts from the extensions 18.

Figure 9:
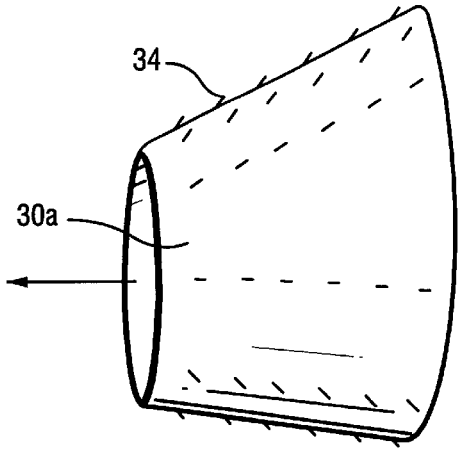
FIG. 9 is a perspective view of an insert with projections for use with the body board product.

Various other means for retaining the inserts within the volumes of the extensions 18 may be provided. For example, as illustrated in FIG. 9, wherein like reference numerals are applied to like parts as in the prior embodiment followed by the suffix "a," each insert 30*a* may be provided with a plurality of projections 34 about its outer surface. The projections are tapered or angled toward the larger or base end of the frustoconical insert. Consequently, upon receiving the insert 30*a* within the volume of the extensions, the projections 34 engage against the rearward-facing surface of the extensions to inhibit or prevent removal of the insert from the extensions.

Figure 10:
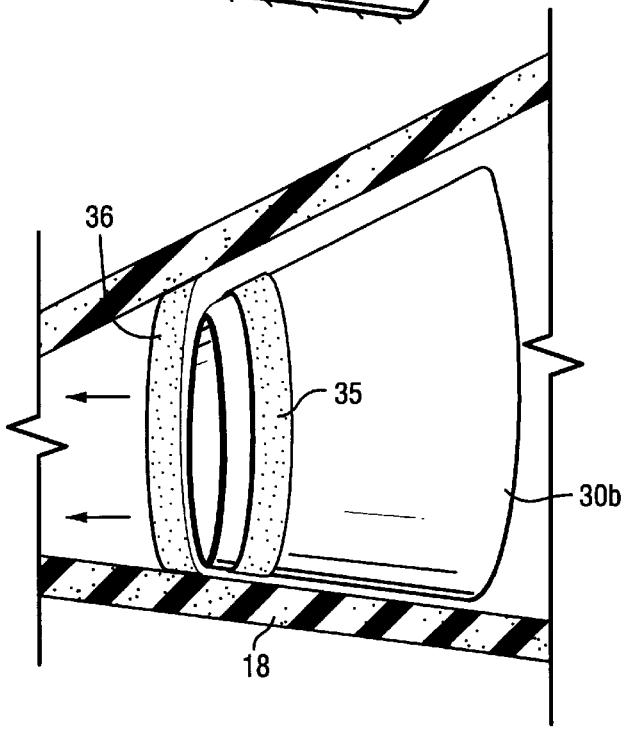
FIG. 10 is a view similar to FIG. 9 illustrating a further form of securement between an insert and an extension.

Referring to FIG. 10, wherein like reference numerals are applied to like parts as in the prior embodiment followed by the suffix "b," each insert 30*b* may be provided with one of hoop-and-loop-type fasteners 35 (i.e., Velcro®) cooperable with another of the hook-and-loop-type fasteners 36 formed along the interior surface of the extension 18. Consequently, upon insertion of insert 30*b* into the extension through its rear or open end, the hook-and-loop fasteners 35 and 36 will engage one another, inhibiting or preventing removal of the insert 30*b* from the extension.

Figure 11:
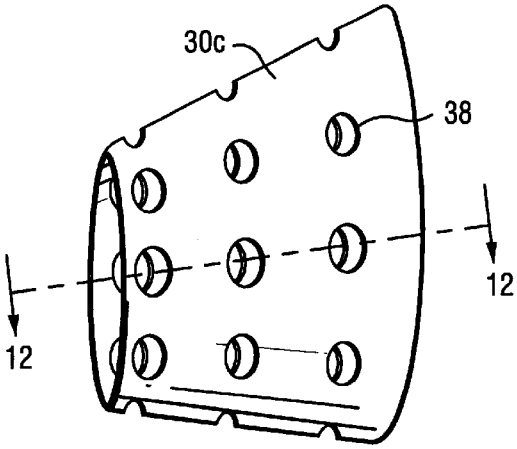
FIG. 11 is a perspective view of a further form of insert.
Figure 12:
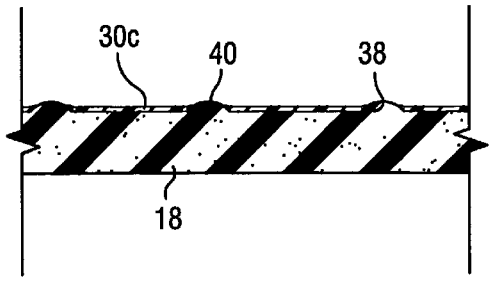
FIG. 12 is a cross-sectional view thereof taken about on line 12—12 in FIG. 11 illustrating the insert in cooperation with the flexible material of an extension.

Referring now to FIGS. 11 and 12, wherein like reference numerals are applied to like parts as in the prior embodiment followed by the suffix "c," each insert 30*c* may be provided with a plurality of holes or openings 38 separated one from the other about the periphery of the insert. It will be appreciated that upon insertion of the inserts 30*c* into the extensions, the flexible material, as illustrated in FIG. 12, of the extension 18 projects inwardly of the insert into the openings 38. Those projections 40 serve as stops inhibiting or preventing removal of the insert 36*c* from each extension 18. It will be appreciated the various other types of releasable securement between the inserts and the extensions may be provided as desired.

Figure 13:
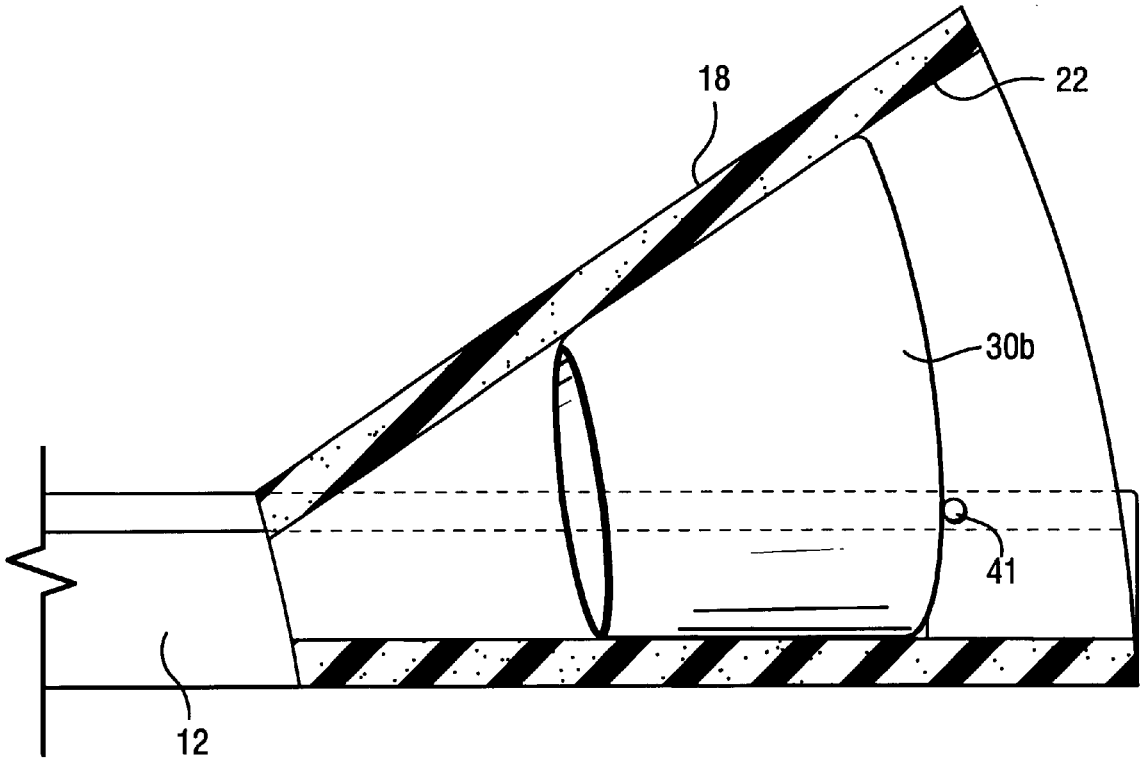
FIG. 13 is a view similar to FIG. 10 illustrating a further form of securement between the insert and extension.

Referring to FIG. 13, wherein like reference numeral are applied to like parts as in the prior embodiment followed by the suffix "d," there is provided a pin 41 for retaining the insert 30*d* within the receptacle 20. The pin projects to a limited extent into the volume 22 and engages the rear edge of the insert 30*d* to retain the insert within the volume 22 of the extension 18.

It will be appreciated that with the foregoing construction, the extensions may be folded to reduce the bulk, e.g., the lateral and height dimension of the board product for packaging, handling, storage and transportation purposes. The inserts, of course, are provided separately and preferably in nested relation. Thus, for a given volume, an increased quantity of the product may be provided in comparison with the board product with extensions 18 attached and in their first or operable shape, as illustrated in FIG. 1.

Figure 7:
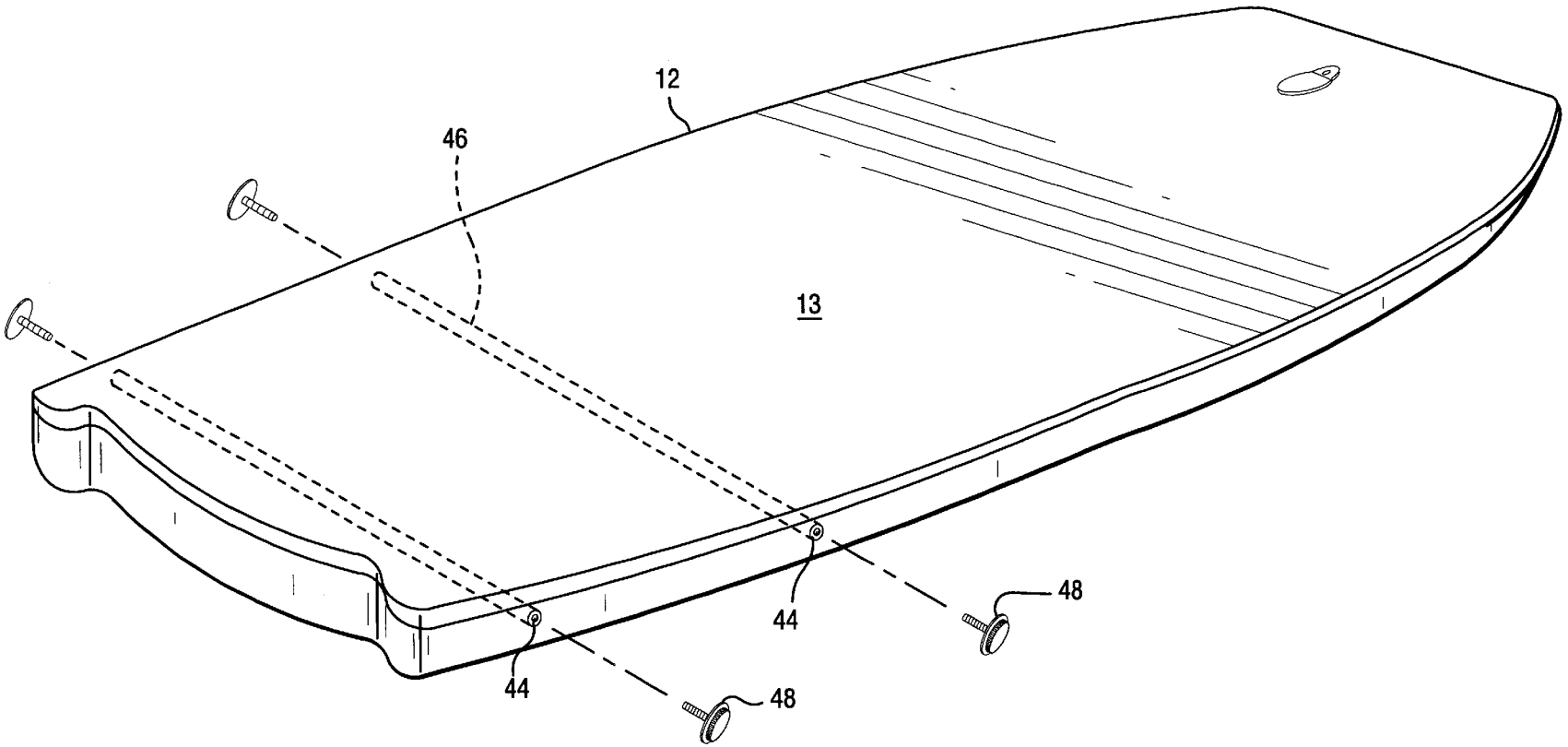
FIG. 7 is a perspective view of a body board illustrating a type of releasable fastener for securing the extensions to the body board.
Figure 8:
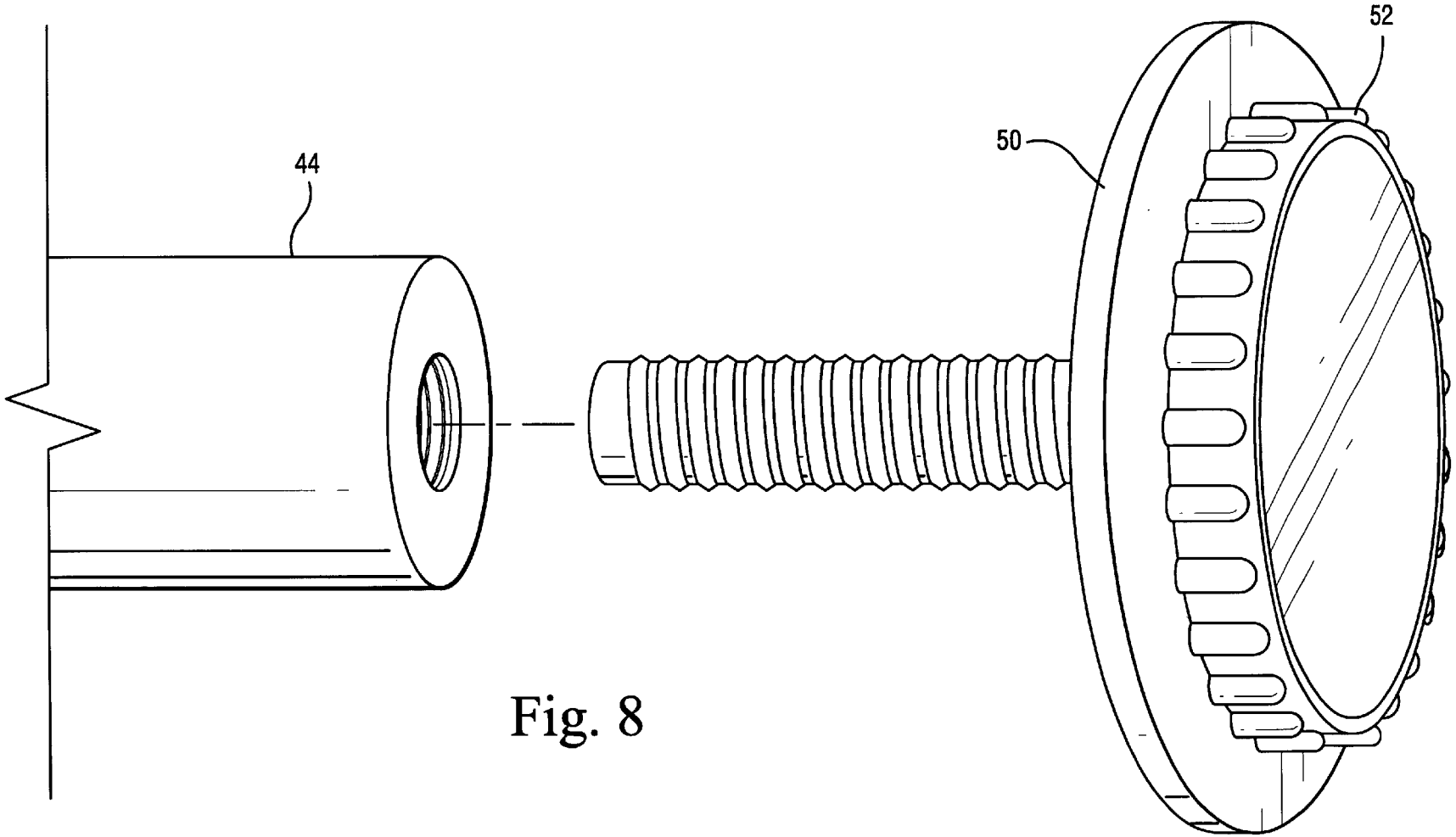
FIG. 8 is an enlarged perspective of the male and female parts employed in the embodiment of FIG. 5.

The extensions also may be releasably secured to the sides of the board. For example, as illustrated in FIGS. 7 and 8, female receptacles 44 may be provided at longitudinally spaced positions along opposite sides of the aft portion of the board member 12. While each of these female receptacles 44 may comprise a separate female receptacle, preferably a pair of rods 46 may be passed through the entire width of the board, terminating at opposite ends in female receptacles 44. Male fastener parts 48 are provided and it will be appreciated that the female and male parts 44 and 48, respectively, have interengaging elements whereby the male and female parts may be releasably secured to one another. While those interengaging parts may comprise a number of different types of parts, for example, bayonet-type joints, screw threads are the interengaging elements of choice. Additionally, because the male parts 48 are inserted through the flexible material of the extensions, a large washer-type head 50 is provided to bear against the inside surface of the extension once the male part is disposed through the opening of the extension. Additionally, the head includes a knurled outer portion 52 so that the male fasteners can be applied manually to secure and release the extensions relative to the board member 12. Alternatively, the washer-type head 50 may be rotatable relative to the outer portion 52 so that the portion 52 clamps the washer-type head 50 against the foam of the extension. Consequently, the board 10 may be used with or without the extensions 18 as desired.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent products and processes.

What is claimed is:

1. A body board comprising:

an elongated body board member having a bow and a stern and substantially flat surfaces on opposite sides, said body member being capable of supporting an individual lying on a first flat surface thereof;

a pair of extensions coupled to said body member adjacent opposite sides of said body member, each extension of said pair of extensions and in a first configuration thereof having a first height dimension, each extension providing an aft facing surface so that water delivered in a direction generally toward said body member and the stern thereof exerts a force against said aft-facing surface to propel said body board; and said aft-facing surface of each extension in said first configuration thereof defining an interior volume of decreasing cross-sectional area in a direction toward said bow, each said extension being formed of a flexible material enabling the extension to be folded into a second configuration at least in part overlying one of said flat surfaces of said board to provide a second height dimension thereof less than said first height dimension and a reduced interior volume.

2. A body board according to claim 1 including means for maintaining said flexible material of said extensions in said first configuration thereof.

3. A body board according to claim 1 including an insert for each extension formed of a material substantially more rigid than said flexible material forming said extensions, each said insert being receivable in said volume of each extension and having a cross-sectional configuration generally corresponding to a cross-section of said extension in said first configuration thereof and at least at a predetermined location therealong to maintain the extension in said first configuration thereof.

4. A body board according to claim 3 wherein said insert has a length less than the length of said volume from the aft end of said extension forwardly to a forward end of said extension and forms a portion of said aft-facing surface of the extension in said first configuration thereof.

5. A body board according to claim 3 including a stop for releasably retaining each said insert in said volume of each extension in said first configuration thereof.

6. A body board according to claim 5 wherein each said extension includes an open end facing in a stern direction, said stop being carried by said extension along an inside surface thereof and projecting into said volume for engaging a portion of said insert and at least inhibiting removal thereof through said open end.

7. A body board according to claim 6 wherein said stop includes a pin for retaining said insert in said extension in said first configuration thereof.

8. A body board according to claim 5 wherein each said extension includes an open end facing in a stern direction, said stop including a projection formed of said flexible material whereby, upon deformation of said stop, said insert is released for removal of said insert through said open end of said extension.

9. A body board according to claim 5 wherein each extension includes an open end facing in a stern direction, said stop including at least one projection on said insert and engageable with said extension to at least inhibit removal of said insert through said open end thereof.

10. A body board according to claim 5 wherein each extension includes an open end facing in a stern direction, said stop including at least one opening formed in said insert for receiving a portion of the flexible material of the extension and forming a projection within said insert opening for at least inhibiting removal of said insert through said open end of the extension.

11. A body board according to claim 5 wherein each extension includes an open end facing in a stern direction, said stop including cooperable hook-and-loop fasteners cooperable between said insert and said extension.

12. A body board according to claim 1 wherein said extensions are releasably secured to said body member.

13. A body board according to claim 12 including a pair of female receptacles along each of the opposite sides of said body member, a pair of male parts extending from said extensions into said female receptacles and having interengaging surfaces with said female receptacles for releasably securing said extensions to said body member.

14. A body board according to claim 13 wherein said female receptacles are formed on the ends of rods extended through the body member between opposite sides thereof, said interengaging surfaces including screw threads, said male parts extending through said extensions and having heads accessible within said volume enabling the male parts to be screwed and unscrewed relative to said female receptacles from within said volume of said extensions.

15. A body board according to claim 1 wherein each said extension has an opening at a forward end thereof.

16. A body board according to claim 15 wherein each extension has a generally conical configuration.

17. A body board according to claim 1 wherein each extension is configured so that an area defined by said aft-facing surface is substantially equivalent to a maximum cross-sectional area of said extension, wherein a cross-sectional area of said extension is defined by a plane generally perpendicular to a longitudinal axis of said body member and each extension in said first configuration having said maximum cross-sectional area located proximate said stern of said body member.

18. A body board comprising:

an elongated body board member having a bow and a stern and substantially flat surfaces on opposite sides, said body member being capable of supporting an individual lying on a first flat surface thereof;

a pair of extensions releasably coupled to said body member adjacent opposite sides of said body member, each extension of said pair of extensions and in a first configuration thereof having portions extending beyond the height and lateral confines of the board to define a first envelope, each extension having an aft facing surface so that water delivered in a direction generally toward said body member from the stern thereof exerts a force against said aft-facing surface to propel said body board; and said aft-facing surface of each extension in said first configuration thereof defining a volume of decreasing cross-sectional area in a direction toward said bow and open at any aft end of said extension, each said extension being formed of a flexible material enabling the extension to be folded into a second configuration at least in part overlying one of said flat surfaces of said board to provide a second envelope within and reduced relative to the vertical confines of the first envelope.

19. A body board according to claim 18 including means for maintaining said flexible material of said extensions in said first configuration thereof.

20. A body board according to claim 18 including an insert for each extension formed of a material substantially more rigid than said flexible material forming said extensions, each said insert being receivable in said volume of each extension and having a cross-sectional configuration generally corresponding to a cross-section of said extension in said first configuration thereof and at least at a predetermined location therealong to maintain the extension in said first configuration thereof.

21. A body board according to claim 18 including a pair of female receptacles along each of the opposite sides of said body member, a pair of male parts extending from said extensions into said female receptacles and having interengaging surfaces with said female receptacles for releasably securing said extensions to said body member.

22. A body board according to claim 21 wherein said female receptacles are formed on the ends of rods extended through the body member between opposite sides thereof, said interengaging surfaces including screw threads, said male parts extending through said extensions and having heads accessible within said volume enabling the male parts to be screwed and unscrewed relative to said female receptacles from within said volume of said extensions.

* * * * *